US005617954A

United States Patent [19]

Kato et al.

[11] Patent Number: 5,617,954

[45] Date of Patent: Apr. 8, 1997

[54] CONTAINER OF SOLID PROCESSING AGENT USED FOR SILVER HALIDE PHOTOSENSITIVE MATERIAL

[75] Inventors: Masashi Kato; Satoru Kuse, both of Hino, Japan

[73] Assignee: Konica Corporation, Tokyo, Japan

[21] Appl. No.: 298,272

[22] Filed: Aug. 31, 1994

[30] Foreign Application Priority Data

Nov. 19, 1993 [JP] Japan ..... 5-281425
Feb. 17, 1994 [JP] Japan ..... 6-020512

[51] Int. Cl.[6] ..... B65D 83/04

[52] U.S. Cl. ..... 206/539; 206/538; 206/528

[58] Field of Search ..... 206/535, 528, 206/445, 538, 539; 221/197, 287; 354/324

[56] References Cited

U.S. PATENT DOCUMENTS 2,340,636 2/1944 Apfelbaum ..... 206/535
2,578,445 12/1951 Nicolle ..... 206/538
2,843,484 7/1958 Baxendale ..... 96/66
4,194,647 3/1980 Spurrier ..... 221/197
4,817,818 4/1989 Lockhart ..... 221/197
5,318,061 6/1994 Saito .
5,432,583 7/1995 Ishikawa et al. ..... 354/324

FOREIGN PATENT DOCUMENTS 0595312 5/1994 European Pat. Off. .
0631186 12/1994 European Pat. Off. .

*Primary Examiner*—Ted Kavanaugh
*Attorney, Agent, or Firm*—Finnegan, Henderson, Farabow, Garrett & Dunner, L.L.P.

[57] ABSTRACT

A container for holding a solid processing agent used for a silver halide photosensitive material. The container includes a body for accommodating the plural solid processing agents, which are formed as tablets, in alignment. The body has a height (H) in a range from 1.03 to 1.50 times larger than a diameter (D) of the solid processing agents; and the body has a width (W) in a range from 1.03 to 1.50 times larger than a thickness (T) of the solid processing agents.

24 Claims, 13 Drawing Sheets

CONTAINER OF SOLID PROCESSING AGENT USED FOR SILVER HALIDE PHOTOSENSITIVE MATERIAL

BACKGROUND OF THE INVENTION

The present invention relates to a container of solid processing agent used for silver halide photosensitive material and a package containing the solid processing agent. This solid processing agent used for silver halide photosensitive material will be referred to as a processing agent, hereinafter. More particularly, the present invention relates to a container of solid processing agent used for silver halide photosensitive material in which the problems of damage of the solid processing agent and occurrence of powder are solved in the process of conveyance or handling in the case where the solid processing agent is formed into tablets.

Usually, silver halide photosensitive material is subjected to development processing, using processing solutions such as a monochromatic developing solution, fixing solution, color developing solution, bleaching solution, bleaching and fixing solution, and stabilizing solution. For convenience, each processing solution is usually put into plastic bottles in the form of a single type processing solution or a plurality of types of processing solutions, and these bottles filled with the processing solution are supplied to users as a processing solution kit. Users dissolve the processing solution kit in water, so that the processing solution can be used for development as a starting solution or a replenishing solution.

Recently, in the business world of photographic processing, the number of small-scale developing factories referred to as a mini-laboratory is increased, wherein automatic small developing apparatus are used in the mini-laboratory. As the number of the mini-laboratories is increased, the number of plastic bottles used for processing solution is sharply increased every year.

Since plastic is light and strong, it is widely used not only for the bottles of photographic processing solutions but also for other purposes. Production of plastic is increased in the world every year. In 1988, the annual production exceeded a hundred million tons. On the other hand, an amount of waste plastic is large. For example, in Japan, about 40% of its production is discarded as waste. When waste plastic is discarded into the sea, environmental problems are caused, and marine animals are affected. In Europe, waste plastic is incinerated in incinerators, the exhaust gas processing devices of which are incomplete, which is one of the causes of acid rain, and the problems of acid rain become acute every year.

In the circumstances described above, it is not preferable that a large number of plastic bottles are used for the photographic processing solutions.

In order to solve the above problems, consideration is given to a countermeasure in which the photographic processing agent is changed into powder. In this case, the following problems may be encountered: In the process of dissolving powder of the photographic processing agent, powder is scattered and workers inhale the scattered powder, which is not good for workers health. Further, the scattered powder is mixed with another photographic processing agent, and the mixed photographic processing agent deteriorates the photographic performance.

In order to overcome the above disadvantages, a technique is disclosed, in which the photographic processing agent is changed into granules, that is, the photographic processing agent is changed into a granule mixture. This technique is disclosed in Japanese Patent Publication Open to Public inspection Nos. 109042/1990, 109043/1990 and 39735/1991 and U.S. Pat. No. 2,843,484. However, even when the above technique is adopted, the following problems may be encountered: Powder of the photographic processing agent is scattered, which affects the worker's health. Scattered powder is mixed with another processing solution in the form of impurities. A caking phenomenon is caused, in which the dissolved powder is deposited and coagulated on the bottom of a container. Granules of the photographic processing agent are coated with wet films which make the dissolution of granules difficult. Therefore, the scope of use of granular photographic processing agent is limited.

In order to solve the above problems utilizing the advantages of the solid type photographic processing agent, a tablet type photographic processing agent is disclosed in Japanese Patent Publication Open to Public Inspection Nos. 61837/1976 and 119454/1993.

Even when the above tablet type processing agent is adopted, several disadvantages may be encountered. For example, while the tablet type processing agent is transported being put in a container, the tablets in the container are damaged and powdered by the vibration and shock given to the tablets. When the tablets are damaged in the manner described above, it is impossible to charge an accurate amount of processing agent into the automatic developing unit, and the concentration of the processing agent in the processing tank can not be maintained at a predetermined value. Therefore, the photographic performance can not be maintained at a predetermined level.

Further, the powdered processing agent obstructs the conveyance of the tablets when they are sent out from the container. Furthermore, the powder adheres to a charging port of the automatic developing unit and absorbs moisture and coagulates. Due to the foregoing, the charging port is narrowed, which makes it difficult to charge the tablets through the charging port.

The present inventors have made various investigations and discovered the following: In the case where the tablets of photographic processing agent are accommodated in a container, dimensions of the container are determined in a specific range with respect to the height and thickness of the tablets. Due to the foregoing, the above problems can be solved.

SUMMARY OF THE INVENTION

The present invention has been achieved to solve the problems described before. The first object of the present invention is to provide a container of solid processing agent used for silver halide photosensitive material in which the tablets of processing agent are not damaged and powdered in the process of transportation and handling. The second object, of the present invention is to reduce an amount of packing material including plastic bottles used for processing agent. The third object of the present invention is to provide a container of solid processing agent used for silver halide photosensitive material by which a predetermined amount of tablet type solid processing agent can be accurately charged into an automatic developing unit.

The present invention is to provide a container of a solid processing agent used for a silver halide photosensitive material into which plural tablets of solidsprocessing agent used for silver halide photosensitive material are accommodated in alignment, and to provide a package of the container and the solid processing agent. The height (H) of a chamber within the container is in a range from 1.03 to 1.50 times large than the diameter (D) of the tablet type solid processing agent, and the width (W) of the chamber is in a range from 1.03 to 1.50 times larger than the thickness (T) of the tablet type solid processing agent.

The tablet used in the present invention is defined as a solid processing agent used for processing silver halide photosensitive material, and the solid processing agent is formed into a tablet having a predetermined configuration when pressure is applied. The diameter (D) of the tablet is defined as the longest diameter on a surface perpendicular to the compressing direction in the case where the tablet is formed. The thickness (T) of the tablet is defined as the longest diameter on a surface in the compressing direction where the tablet is formed. Concerning the container of the present invention into which the tablets are charged, the tablets are capable of moving in a chamber of the container. The height (H) of the chamber is defined as the shortest length inside the container in the direction of the diameter (D) of the tablet. The width (W) of the chamber is defined as the shortest length inside the container in the direction of the thickness (T) of the tablet.

The tablets used for processing silver halide photosensitive material relating to the present invention can be manufactured by a conventional method. For example, the conventional methods are disclosed in Japanese Patent Publication Open to Public Inspection Nos. 61837/1976 and 155038/1979 and British Patent No. 1,213,808. The following methods are applied for manufacturing the tablets relating to the present invention: ( (1) Powder of each processing agent is mixed and then pressed so as to be formed into tablets.

(2) Each powder is mixed and formed into granules. Then the granules of processing agent are formed into tablets.

(3) Each powder is formed into granules. The granules are mixed and then pressed so as to be formed into tablets. From the viewpoints of dissolving property, anti-abrasion property and preservation property, the method (3) is most preferably used in the present invention.

The physical properties of the tablet of the present invention are described as follows. The bulk density is 1.0 to 2.5 g/cm$^3$, and preferably the bulk density is 1.1 to 1.9 g/cm$^3$. The mechanical strength Z is $0.3<Z<3.5$ kg/mm, and preferably the mechanical strength Z is $0.5<Z<3.0$ kg/mm. The rupture strength of the tablet of the present invention is defined as a rupture strength measured when pressure is applied to the tablet in the long diameter direction. In this case, the rupture strength can be measured by a measuring device available on the market such as a Monsant type hardness meter, Stoke type hardness meter, and Speed Checker manufactured by Okada Seiko Co.

The water content of the tablet may be in a range from 0.1 to 15 weight %, however, in view of enhancing the effect of the present invention, the water content of the tablet is preferably in a range from 0.3 to 10 weight %, and most preferably the water content of the tablet is preferably in a range from 1 to 8 weight %. The specific volume of the particulate solid processing agent may be in a range from 0.6 to 2.0 cm$^3$/g. Preferably the specific volume of the particulate solid processing agent is in a range from 0.8 to 1.5 cm$^3$/g. The water content may be measured by an electronic type moisture meter available on the market. In this measurement, the tablet is heated to 105° so as to provide a constant weight, and the reduced weight is measured.

Conventional solid photographic processing agents for processing silver halide photosensitive material are applied to the present invention.

Examples of solid photographic processing agents used for color developer include a developing agent, antioxidant, development inhibitor, alkali agent, optical brightening agent, and development accelerator.

An example of usable developing agents is paraphenylene diamine. Examples of usable antioxidants are: hydroxylamine sulfate, diethylhydroxylamine, di (sulfoethyl) hydroxylamine, and sulfite. Examples of usable development inhibitors are: bromide, chloride and iodide. Examples of usable chelate agents are: diethylenetriaminepentaacetate, ethylenediaminetetraacetate, 1-hydroxyethylidene-1,1'-diphosphonate, 1,2-dihydroxybenzene-3,5-disulfonate. Examples of usable alkali agents are: potassium carbonate, sodium carbonate, potassium hydroxide, potassium phosphate, lithium hydroxide, and potassium bicarbonate. Further, solid processing agents used for a bleaching processing agent include a bleaching agent, halide, and bleaching accelerator. Examples of usable bleaching agents are: ferric ethylenediaminetetraacetate, ferric diethylene triaminepentaacetate, and ferrite β-alanindiacetate. Examples of usable halides are: ammonium bromide, and ammonium chloride. Further, the solid processing agents used for a fixing processing agent include a fixing agent, antioxidant, pH adjusting agent, and fixing accelerator. Examples of usable fixing agents are: thioammonium sulfate, thiosodium sulfate, thiocyan salt, and meso-ionic compound. Examples of usable antioxidants are: sulfite, and metabisulfite. Examples of usable pH adjusting agents are: acetate, succinic acid, maleic acid, sodium hydroxide. As a bleaching fixing processing agent, the aforementioned bleaching processing agent and components of fixing processing agent are used. Examples of usable stabilizing agents are: a surface active agent, formaldehyde substitute compound, chelate agent, fungicide, and antioxidant.

The configurations of tablets relating to the present invention are as follows: a short column shape, "Go" stone shape, short triangle pole shape, short square pole shape, and pill shape. In the present invention, a short column shape having an outer circumference on which the short column rolls is preferably used because of convenience of charging.

The outer circumferential surface described in the present invention is defined as a surface connecting the edges of two compression surfaces of the tablet in the thickness (T) direction. In the present invention, the tablets are charged into the container in the following manner: A portion of the outer circumferential surface of one tablet comes into contact with a portion of the outer circumferential surface of another tablet, and the tablets are aligned on a line. While a portion of the outer circumferential surface or the entire outer circumferential surface of the tablet is successively contacted with an inner wall of the container, the tablet can be rotated or slid in the container.

Tablets used for processing silver halide photosensitive material relating to the present invention are tablets for color development, tablets for monochromatic development, tablets for bleaching, tablets for bleaching and fixing, and tablets for stabilization processing.

Examples of usable synthetic resins applied to the container for accommodating the processing agent of the present invention are: polyethylene (either polyethylene made by the high pressure method or polyethylene made by the low pressure method), polypropylene (either drawing or non-drawing), polyvinyl chloride, polyvinyl acetate, nylon (either drawing or non-drawing), polyvinylidene chloride, polystyrene, polycarbonate, vinylon, Evar, polyethylene terephthalate (PET), other polyesters, hydrochlorinated rubber, acrylonitrile-butadiene copolymer, and epoxy-phosphoric acid resin (polymers described in the official gazettes of Japanese Patent Publication Open to Public Inspection Nos. 63037/1988 and 32952/1982). Especially, polystyrene is preferably used. Polystyrene is advantageous in that: it can be easily formed into the container of the present invention; tablets in a polystyrene container are not damaged; polystyrene is easily recycled; and the oxygen transmission property is appropriate, wherein the oxygen transmission property of synthetic resin is preferably not more than 50 $ml/m^2 \cdot 24$ hr·atm in the atmosphere of 20° C. and 65%RH, and more preferably the oxygen transmission property of synthetic resin is not more than 30 $ml/m^2 \cdot 24$ hr·atm. The wall thickness of the container made of synthetic resin used in the present invention is 10 to 3000 μm from the viewpoint of providing the effect of the present invention. Preferably, the wall thickness of the container is 200 to 2000 μm.

From the viewpoint of providing the effect of the present invention, the bulk density of the tablet of the present invention is preferably 1.1 to 3.0 $g/cm^3$. More preferably, the bulk density of the tablet of the present invention is 1.2 to 2.4 $g/cm^3$. In order to adjust the bulk density to the value described above, the compression forming pressure of a tablet forming machine is adjusted, and the composition of a binder such as polyethylene glycol or saccharides is adjusted.

The height (H) of a chamber within the container of the present invention is in a range from 1.03 to 1.50 times of the diameter (D) of the tablet type solid processing agent, and the width (W) of the chamber is in a range from 1.03 to 1.50 times of the thickness (T) of the tablet type solid processing agent. Due to the foregoing, damage of the tablets can be prevented in the process of transportation, and also the tablets are not powdered. Especially when the ratio H/D is in a range from 1.05 to 1.30 and the ratio W/T is in a range from 1.05 to 1.40, more excellent results can be provided. On the other hand, when the above ratio is lower than 1.03, the tablets absorbs the moisture in the container, so that the container gets clogged by expanded tablets. Therefore, the tablets can not be conveyed smoothly. In the case where the ratio is higher than 1.50, the tablets are damaged while they are conveyed, and powder is generated, which will cause problems.

DETAILED DESCRIPTION OF THE INVENTION

With reference to the accompanying drawings, an example of the present invention will be explained as follows.

Figure 1:
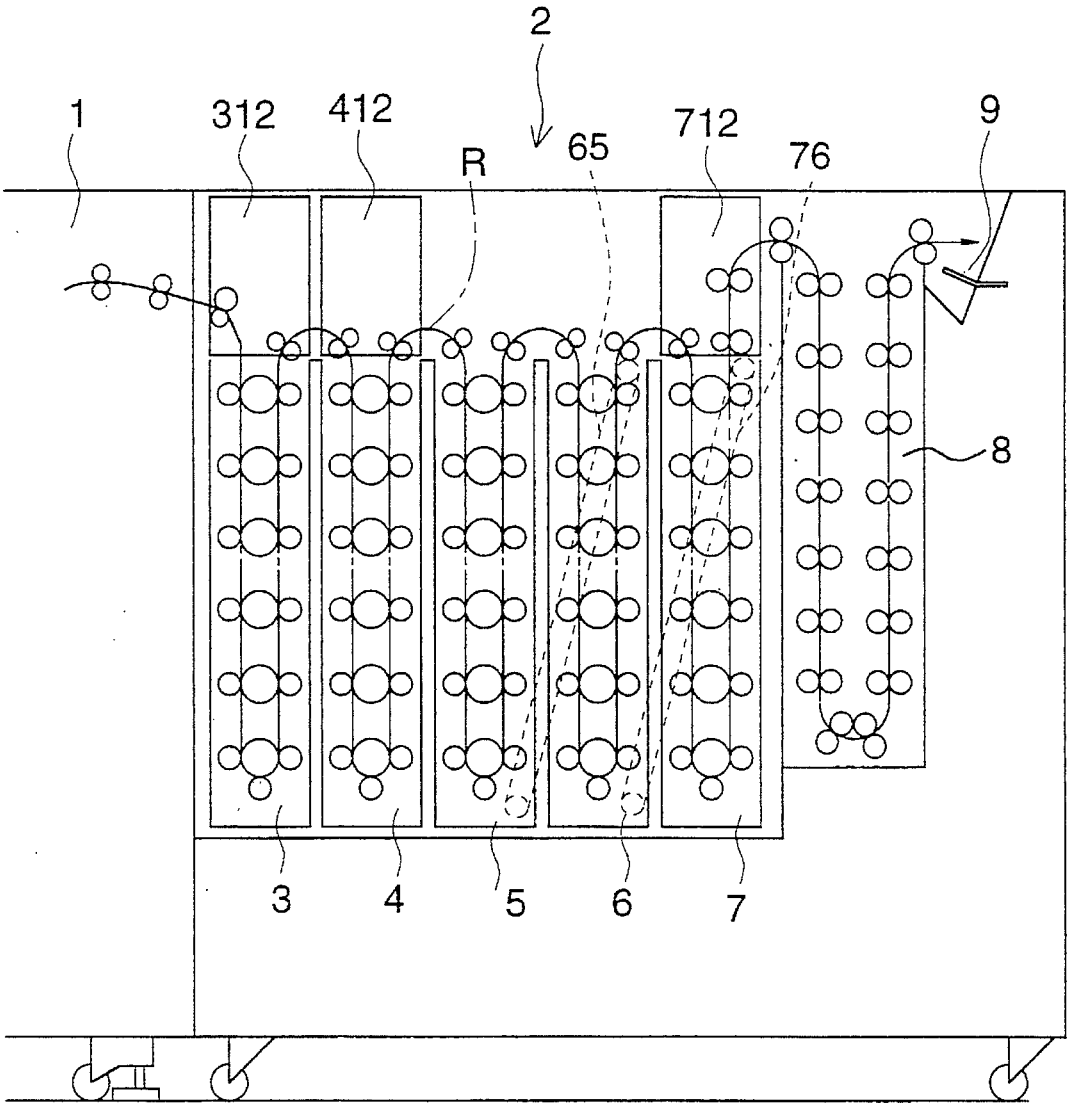
FIG. 1 is a view showing the primary construction of an automatic developing unit to which the processing agent container of the present invention is applied.
Figure 2:
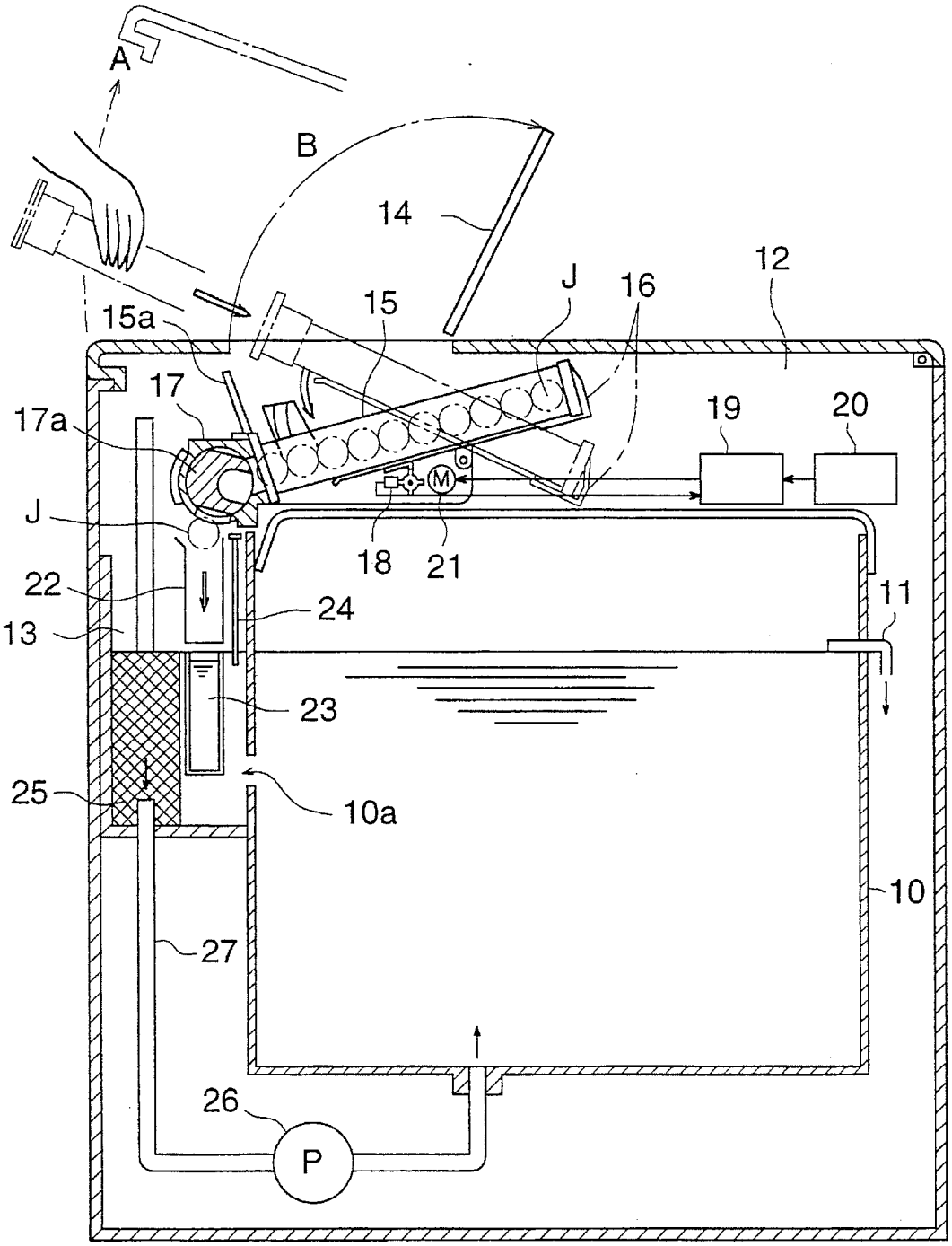
FIG. 2 is a sectional view of the automatic developing unit in which the processing tank having a processing agent supply section is shown.
Figure 3A:
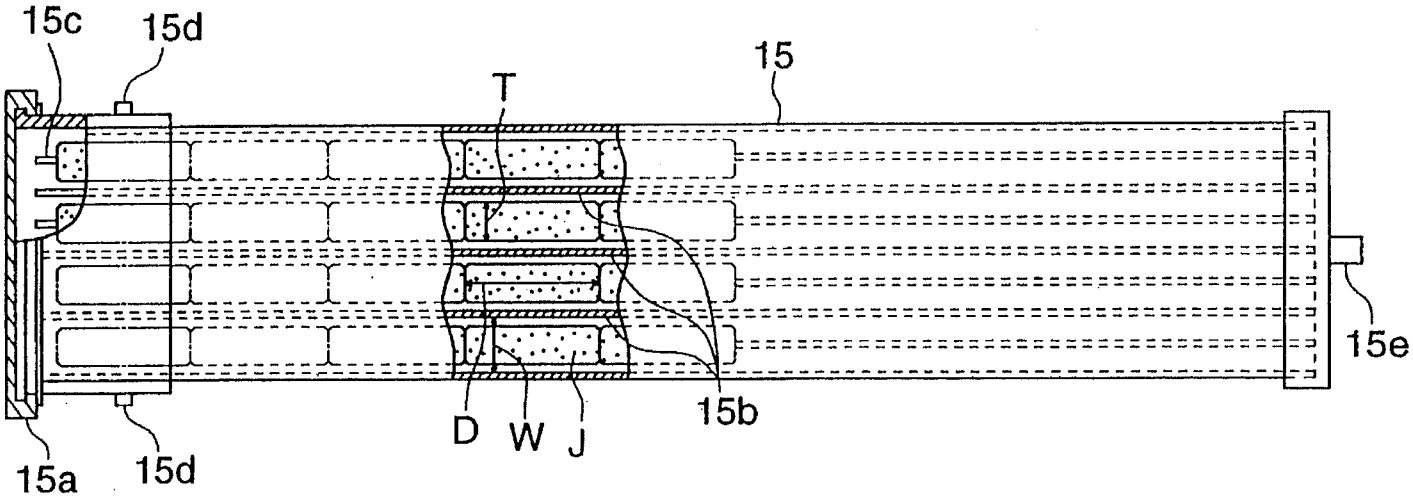
FIG. 3(A) is a plan view and FIG. 3(B) is a side view showing an example of the processing agent container of the present invention.
Figure 3B:
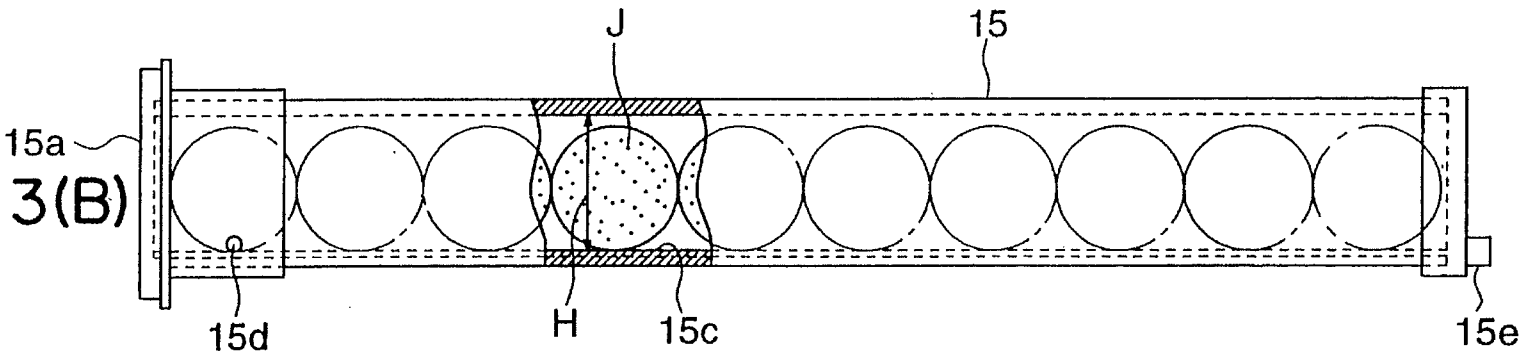
Figure 4:
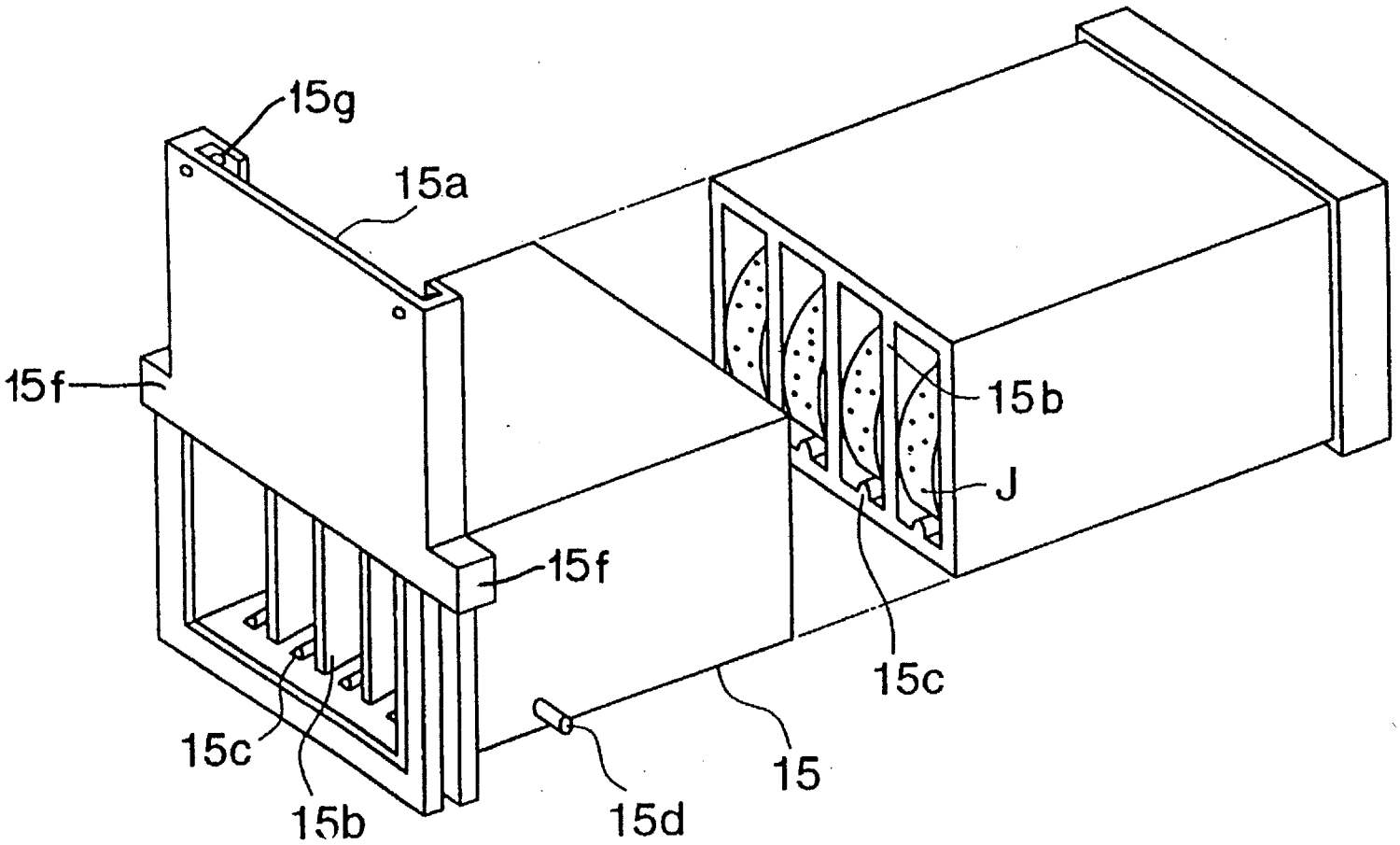
FIG. 4 is a perspective view showing an example of the processing agent container of the present invention.
Figure 5:
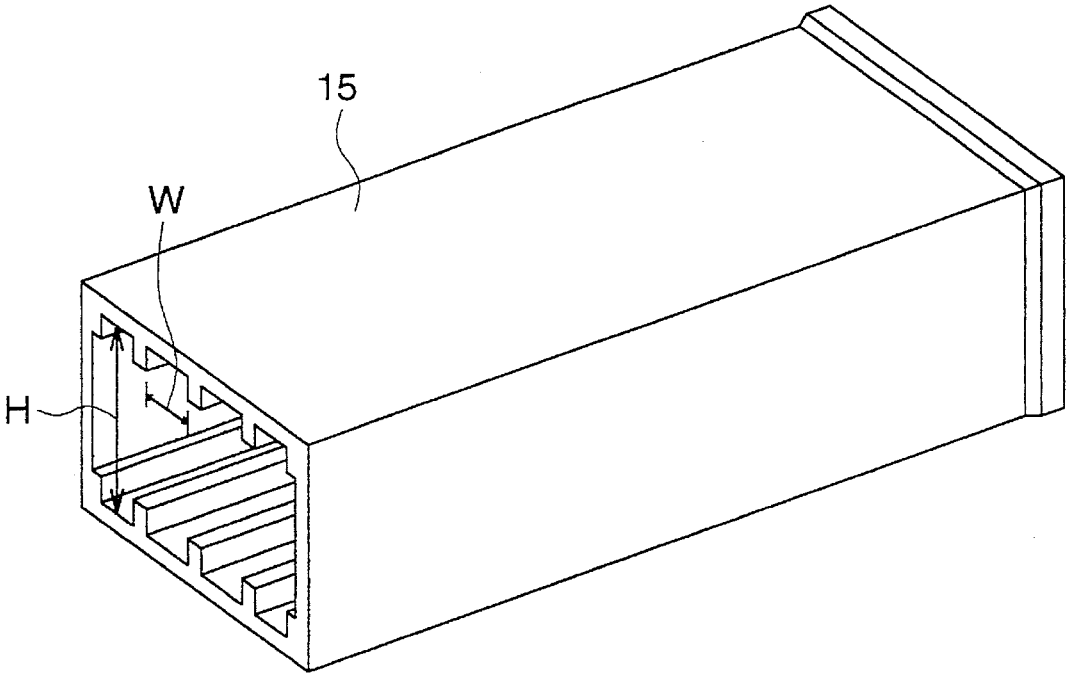
FIG. 5 is a partial perspective view showing another example of the processing agent container of the present invention.
Figure 6:
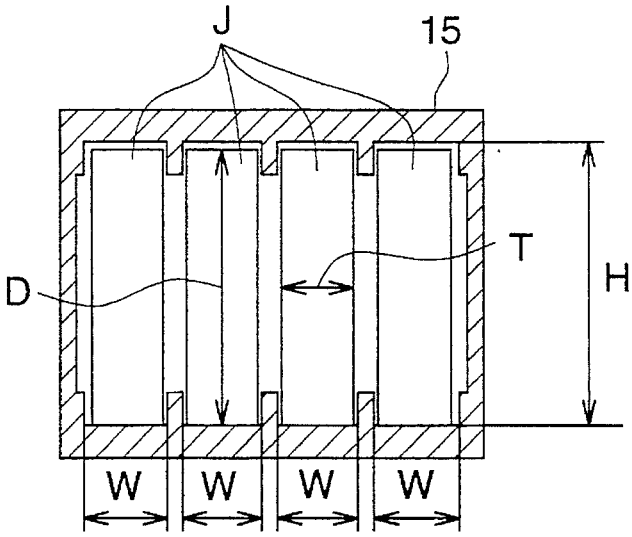
FIG. 6 is a sectional view showing another example of the processing agent container of the present invention.
Figure 7:
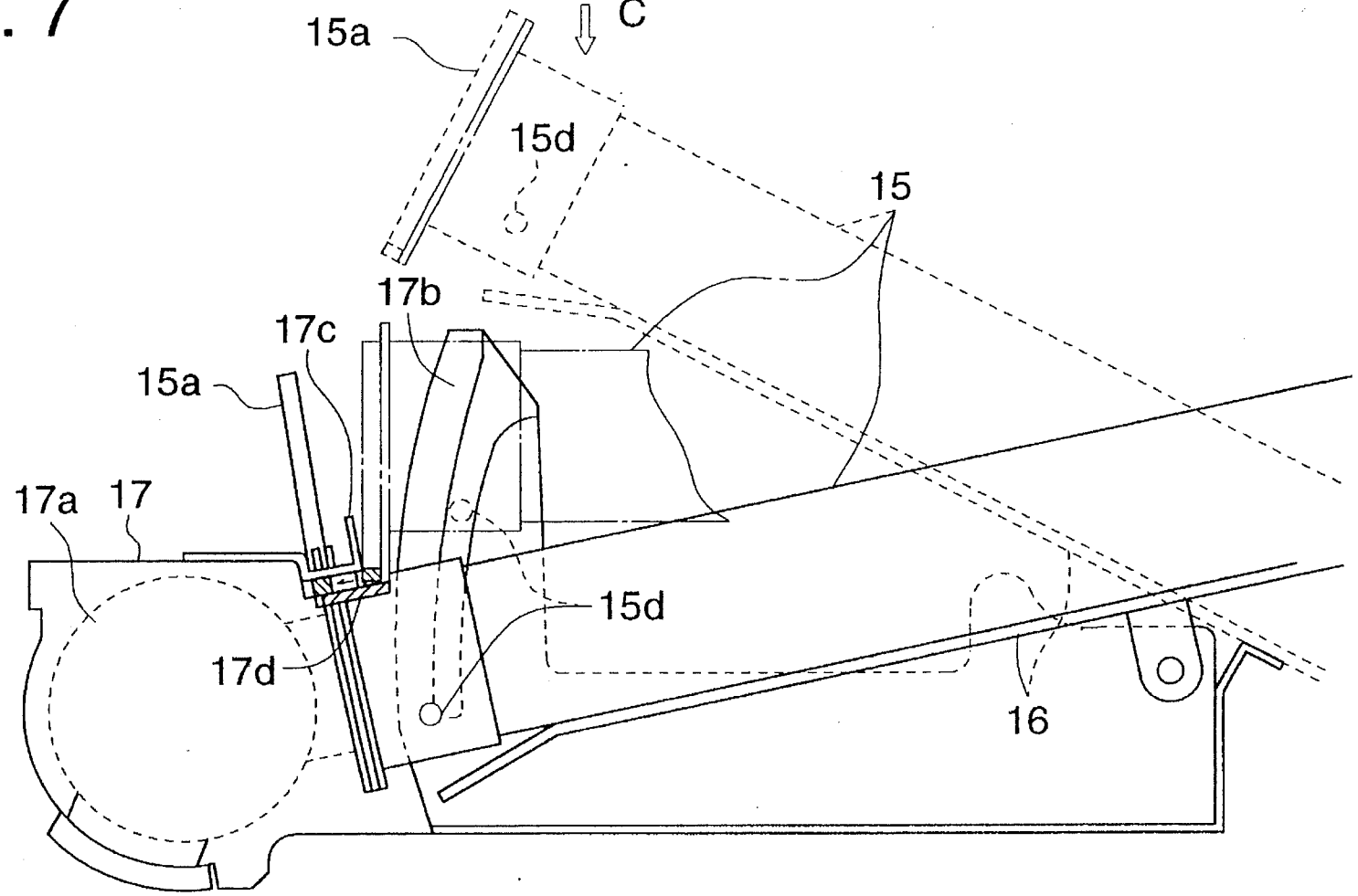
FIG. 7 is a side view showing an outline of the example of the tablet supply device.
Figure 8:
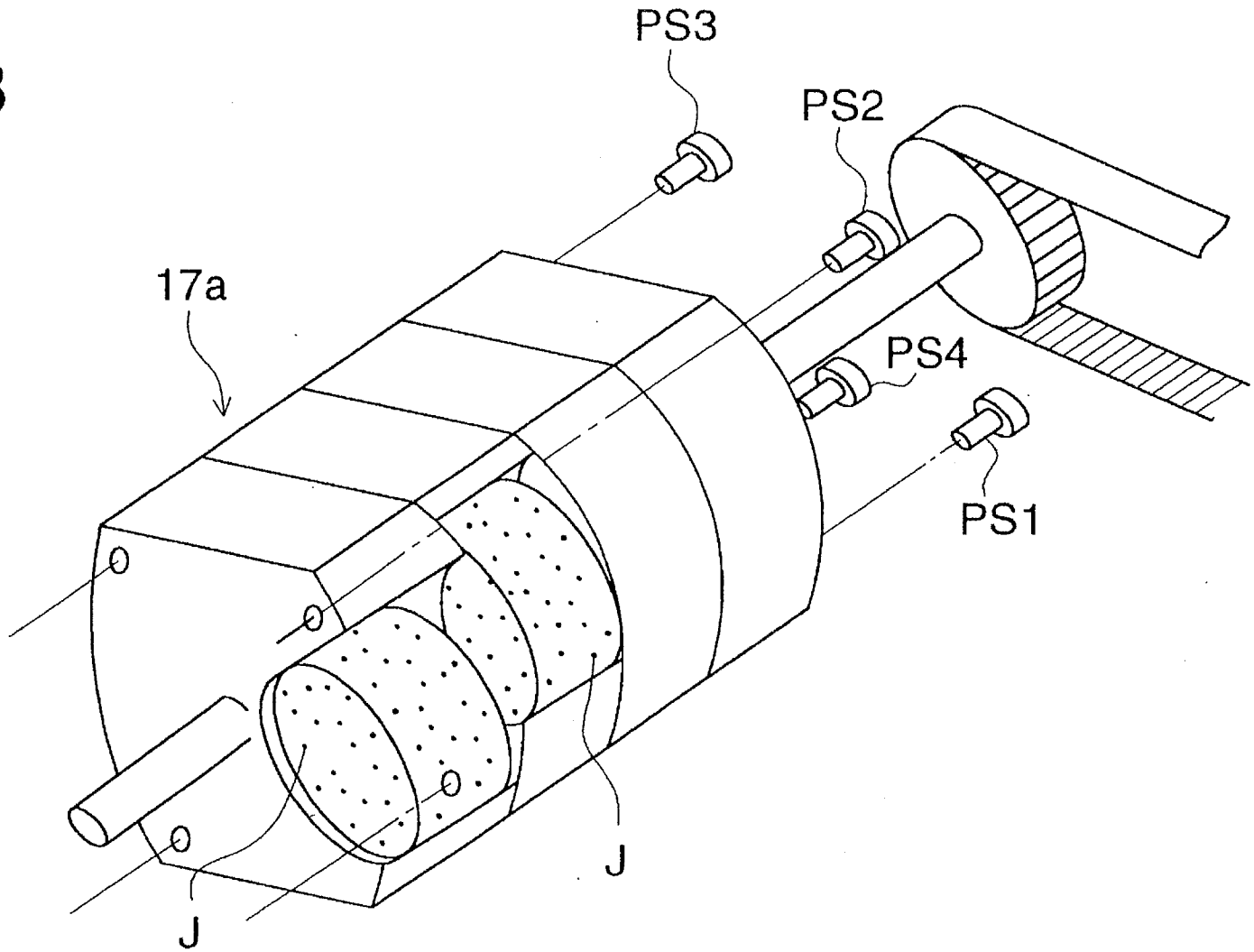
FIG. 8 is a perspective view showing an example of the supply rotor of the tablet supply device.

FIG. 1 is a view showing the primary construction of an automatic developing unit to which the processing agent container of the present invention is applied. FIG. 2 is a sectional view of the automatic developing unit in which the processing tank having a processing agent supply section is shown. FIG. 3(A) is a plan view and FIG. 3(B) is a side view showing an example of the processing agent container of the present invention. FIG. 4 is a perspective view showing an example of the processing agent container of the present invention. FIG. 5 is a partial perspective view showing another example of the processing agent container of the present invention. FIG. 6 is a sectional view showing another example of the processing agent container of the present invention. FIG. 7 is a side view showing an outline of the example of the tablet supply device. FIG. 8 is a perspective view showing an example of the supply rotor of the tablet supply device.

In FIG. 1, numeral 1 is a conventional photosensitive material supply device such as an exposed film supply device or an automatic printer. Numeral 2 is a primary portion of an automatic developing device including a color developing tank 3, a bleaching and fixing tank 4, stabilizing tanks 5, 6, 7, a drying section 8, and a discharge section 9. In the photosensitive material supply device 1 and the primary section of the automatic developing unit 2, the photosensitive material is conveyed along the conveyance passage R shown by a one-dotted chain line by a train of conveyance rollers. Therefore, the photosensitive material is conveyed from the photosensitive material supply device 1 to the discharge section 9 through the tanks 3 to 7 in the automatic developing unit 2 and also through the drying section 8. After that, the photosensitive material is discharged from the discharge section 9.

The color developer in the color developing tank 3, bleaching and fixing solution in the bleaching and fixing tank 4, and stabilizing solution in the stabilizing tanks 5 to 7 are prepared when each processing agent is dissolved in ion exchange water, mineral water or city water. In the process of development, each processing solution in the color developing tank 3 of others is prepared in the following manner: Water is supplied into a tank such as the color developing tank 3 and the like, using a water supply unit (not shown in the drawing) of the prior art, and each processing agent is supplied by the preparing device shown in FIG. 2 in accordance with the throughput of photosensitive material.

The preparation device shown in FIG. 2 is installed in the color developing tank 3, bleaching and fixing tank 4 and stabilizing tank 7.

In this connection, the stabilizing solutions in the stabilizing tanks 5 and 6 are replenished in the following manner: The stabilizing solution that has overflowed the stabilizing tank 7 flows into the stabilizing tank 6 through a connecting pipe 76 shown by a dotted line in FIG. 1. In the same manner, the stabilizing solution that has overflowed the stabilizing tank 6 flows into the stabilizing tank 5 through a connecting pipe 65 shown by a dotted line in FIG. 1. Therefore, the stabilizing solution prepared in the stabilizing tank 7 is used in the stabilizing tanks 6 and 5. Numerals 312, 412,712 are processing agent supply sections for supplying the processing agent to the preparing device.

In FIG. 2, numeral 10 is a processing tank corresponding to one of the color developing tank 3, bleaching and fixing tank 4 and stabilizing tank 7. In this drawing, the conveyance roller trains are omitted. Numeral 11 is an overflow pipe. In the cases of the color developing tank 3 and the bleaching and fixing tank 4, the overflow pipes are connected to an individual or common waste solution tank. However, in the case of the stabilizing tank 6, the overflow pipe is connected to the stabilizing tank 6, that is, the overflow pipe corresponds to the connection pipe 76 described before. The aforementioned overflow pipe is also provided in the stabilizing tank 5 which is the final tank in the circulation of the stabilizing solution.

In FIG. 2, numeral 12 is a processing agent supply section corresponding to the sections denoted by the numerals 312, 412 and 712. Numeral 13 is a processing solution preparing section. When a partial door 14 attached onto a roof board of the primary portion 2 of the automatic developing device, is opened as shown by the line B in FIG. 2, a processing agent container 15 is attached to and detached from the processing agent supply section 12 as shown by the one-dotted chain line A.

The processing agent container 15 is placed on a mount 16 tiltably provided in the processing agent supply section 12. When the mount 16 is tilted counterclockwise from the position shown by a one-dotted chain line to the position shown by a solid line, a delivery side door 15*a* of the processing agent container 15 is opened, and the delivery end of the processing agent container 15 coincides with a receiving end of the tablet supply device 17. Information expressing the setting of the processing agent container 15 is inputted from the setting detection means 18 to the processing agent supply control section 19.

There is provided a throughput detection means 20 at a photosensitive material receiving port of the primary portion 2 of the automatic developing device. Throughput information such as an area of the photosensitive material sent to the automatic developing device is inputted from the throughput detection means 20 to the processing agent supply control section 19. According to the setting information and the throughput information, the processing agent supply control section 19 drives a supply motor 21 so that a supply rotor 17*a* of the tablet supply device 17 is rotated. Each time the supply rotor 17*a* is rotated by one revolution, a tablet J rolls into a cutout portion for receiving one tablet of processing agent formed on the supply rotor 17*a*. Then the tablet J falls into a dissolution section 23 of the processing solution preparing section 13 through a chute 22. It is preferable that the tablet J is formed into a configuration having a rolling circumference, however, the tablet J may be formed into a configuration appropriate for sliding.

The processing agent container 15 is shown in detail in FIGS. 3 and 4. In the processing agent container 15, a plurality of tablets J are aligned in four tablet accommodating chambers in such a manner that the rolling outer circumferences of the tablets J come into contact with each other, wherein the tablet accommodating chambers are separated by partition walls 15*b*. Until the processing agent container 15 is set in the tablet supply device 17, the delivery,side door 15*a* airtightly closes the tablet accommodating chamber, so that the accommodated tablets J having a high moisture-absorbing property seldom absorb moisture. Numeral 15*c* is a rail for smoothing the roll of the tablets J. Numeral 15*d* is a cam pin by which the delivery end of the processing agent container 15 is closely adhered to the receiving end of the tablet supply device 17. Numeral 15*e* is a discriminating protrusion by which the processing agent container 15 can be set on the mount of a correct processing tank. For example, the processing agent of the color developing tank 3 is prevented from being replenished into the bleaching and fixing tank 4.

The processing agent container 15 shown in FIGS. 5 and 6 are constructed in the following manner: An intermediate portion of the partition wall 15*b* of the processing agent container 15 shown in FIGS. 3 and 4 is cut away. Even in this construction, the tablets J in the tablet accommodating chamber can be smoothly guided by the residual partition wall connected to the roof and the floor of the container. When this container 15 is compared with that shown in FIGS. 3 and 4, a lower frictional force is given to the tablet J, however, air tends to flow into the container from the delivery side. In this way, this container has both an advantage and a disadvantage.

EXAMPLE 1

In the processing agent container 15 described above, the following relation is maintained:

$1.03 \leqq H/D \leqq 1.50$ $1.03 \leqq W/T \leqq 1.50$ where H is the height of each tablet accommodating chamber, W is the width of each tablet accommodating chamber, D is the diameter of the tablet J, and T is the width of the tablet J.

Due to the foregoing, the delivery side door 15*a* of the processing agent container 15 which has airtightly closed the tablet accommodating chamber is opened, so that the processing agent container 15 is set in the tablet supply device 17. In this way, the tablet J can be dropped one by one into the dissolution section 23 of the processing solution preparing section 13. Therefore, even when air coming into contact with the solution surface enters the processing agent container 15 through the tablet supply device 17, the tablet J on the most delivery side exclusively absorbs moisture, so that moisture is prevented from entering the tablet accommodating container. Therefore, the inner tablets J seldom absorb moisture. The tablet J are supplied to the tablet supply device 17 in such a manner that the tablets J roll into the tablet supply device 17 one by one. Due to the foregoing, the tablets J are not powdered and damaged, so that the tablets J of the processing agent can be stably and precisely supplied. In this connection, the processing agent container 15 is made of polyethylene of high density, and the thickness of the container is 1000 μm.

The tablet supply device will be explained as follows. FIG. 8 is a perspective view showing an example of the supply rotor 17*a* by which the tablets J in the processing agent container 15 shown in FIGS. 3, 4, 5 and 6 are dropped into the dissolution section 23. This supply rotor 17*a* is provided with a pulley rotated by the supply motor 21. Each time the supply rotor 17*a* is rotated by a half revolution, two tablets J are dropped. PS1 to PS4 are tablet sensors composed of light emitting and light receiving elements, and information expressing whether or not the tablets J are put in four cutout portions of the supply rotor 17*a* for receiving the tablets, is inputted into the processing agent supply control section 19. In accordance with this information, the processing agent supply control section 19 controls the rotation of the supply rotor 17*a*.

In the example illustrated in FIG. 7, the processing agent container 15 is set in the tablet supply device 17 in the following manner. However, it should be understood that the present invention is not limited to the specific example.

As illustrated by a dotted line in FIG. 7, the processing agent container 15 is placed on the mount 16, and the mount 16 is tilted together with the processing agent container 15 counterclockwise to a position shown by a solid line, resisting the force of a spring not shown in the drawing. During the tilting operation, the cam pin 15*d* of the processing agent container 15 is engaged with the cam groove 17*b* formed on the side plate of the tablet supply device 17 and guided by the cam groove 17*b*. When the cam pin 15*d* enters a curved portion formed at the lower end of the cam groove 17*b*, the delivery end of the processing agent container 15 is closely contacted with the receiving end of the tablet supply device 17, and at the same time, when the clockwise tilting motion of the mount 16 energized by a spring, is checked, the processing agent container 15 is set, that is, the processing agent container 15 is provided. In order to smoothly provide the processing agent container 15 in the apparatus, a resilient member is provided on the mount 16 so as to push the processing agent container 15 so that the cam pin 15*d* can be engaged with the curved end portion of the cam groove 17*b*.

While the cam pin 15*d* is descending in the cam groove 17*b*, protrusions 15*f* protruding from the right and left portions of the lower end of the delivery side door 15*a* of the processing agent container 15 are engaged with the door restricting guides 17*c*, 17*d* provided in the tablet supply device 17, so that the descending motion of the delivery side door 15*a* is stopped. Therefore, when the processing agent container 15 is set at the position shown by the solid line, the delivery side door 15*a* is maintained in an open condition illustrated in FIGS. 4 and 7. In this connection, after the delivery side door 15*a* in FIG. 4 has been lowered so that the delivery end of the processing agent container 15 can be airtightly closed, the delivery side door 15*a* can not be lowered any more by the action of stop pins 15*g* implanted at the right and left upper positions.

When the processing agent container 15 provided at the position shown by the solid line in FIG. 7 is pushed resisting the pushing force impressed by a resilient member (not shown) provided on the mount 16 so that the cam pin 15*d* can be disconnected from the curved end portion of the cam groove 17*b*, the mount 16 is tilted clockwise by the spring force. In accordance with the tilting motion of the mount 16, the processing agent container 15 is also tilted. As a result, the delivery side door 15*a* restricted by the door restricting guides 17*c*, 17*d* closes the delivery end of the processing agent container 15. Under the condition that the delivery side door 15*a* has closed the delivery end of the processing agent container 15, the delivery side door 15*a* is disconnected from the door restricting guides 17*c*, 17*d*, so that the delivery side door 15*a* moves to the position illustrated by the dotted line together with the processing agent container 15. Therefore, as shown by the dotted line in FIG. 2, the processing agent container 15 can be removed from the mount 16, and taken out from the processing agent supply section 12.

Dissolution of the supplied tablets J will be explained as follows. In the example shown in FIG. 2, the processing solution preparing section 13 and the processing tank 10 are communicated with each other through a communication hole 10*a* formed on the boundary wall so that the processing solution can be circulated. The solution level in the processing solution preparing section 13 is maintained equal to that in the processing tank 10, and the dissolution section 23 surrounded by a net or filter is located in the processing solution. Numeral 24 is a heater for heating the solution so that the tablets J can be easily dissolved. In the processing solution preparing section 13, there is provided a filter chamber 25 surrounded by a filter. The bottom of the filter chamber 25 and that of the processing tank 10 are connected by a communicating pipe 27 provided with a pump 26. The pump 26 sends the processing solution in the filter chamber 25 into the processing tank 10. Therefore, the processing solution flows into the filter chamber 25 from the outside. Accordingly, the processing solution flows from the processing tank 10 into the processing solution preparing section 13 through the communicating hole 10*a*. In this way, the processing solution is circulated.

The present invention is not restricted by the example shown in FIG. 2, and the processing solution may be reversely circulated, and the processing solution preparing section may be formed as a portion of the processing tank 10, so that the dissolution section may be provided in the processing tank 10.

Figure 9:
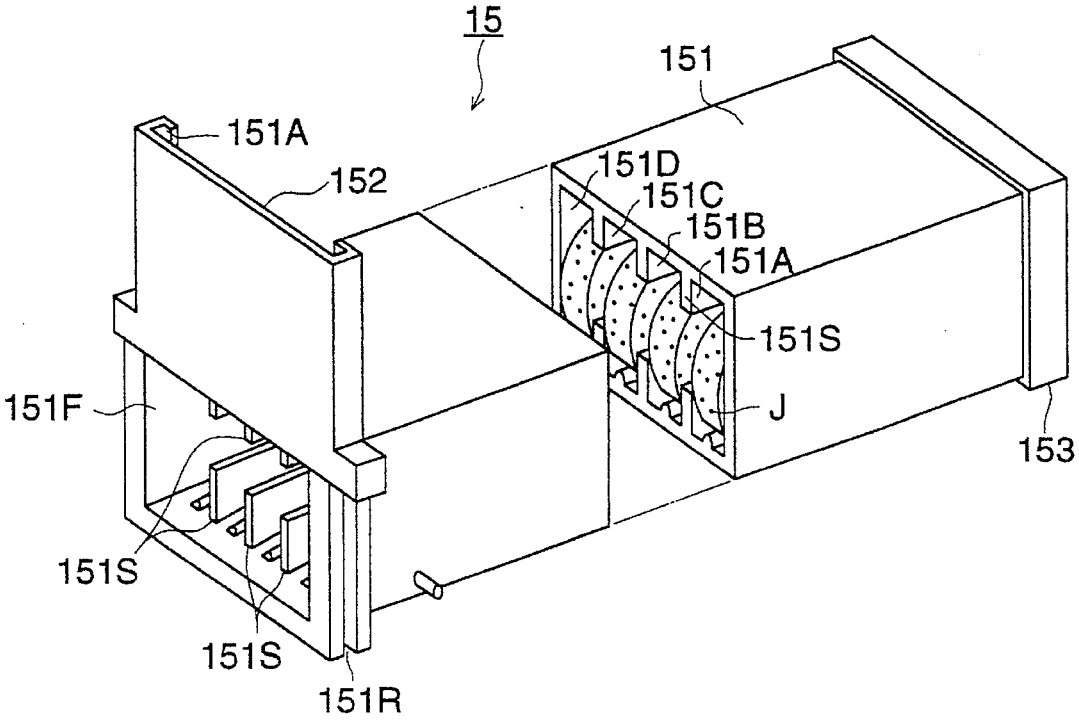
FIG. 9(A) is a perspective view and FIG. 9(B) is a front view showing another example of the solid processing agent container.
Figure 9:
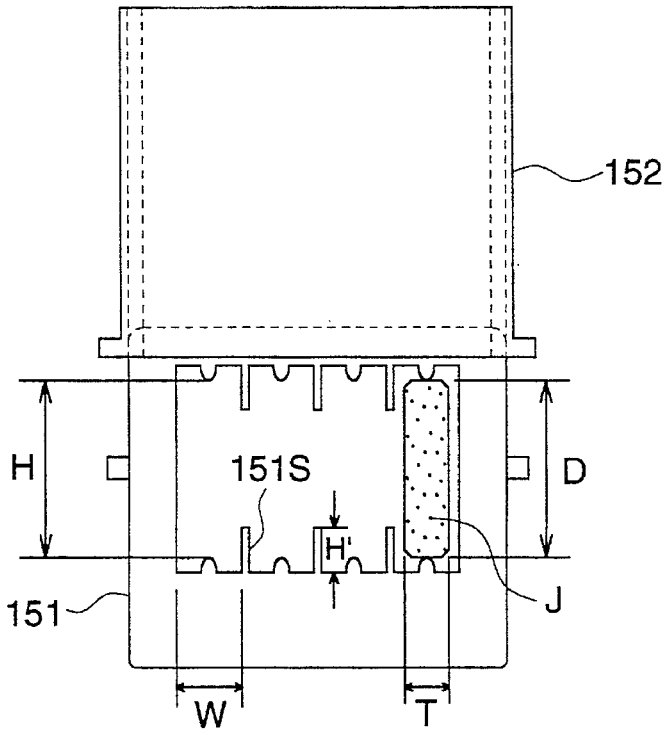

FIG. 9 shows another example of the solid processing agent container 15. FIG. 9(A) is a partially exploded. perspective view of the container, and FIG. 9(B) is a front view of the opening side of the container 15. The solid processing container 15 accommodates a plurality of tablets J of solid processing agent. The solid processing container 15 includes: a hollow-square-pole-shaped container body 151 having an outlet opening 151F from which the solid processing agent J is discharged; an opening and closing door 152 capable of opening and closing the output opening 151F of the container body 151; and a rear cover 153 for closing another opening of the container body 151.

Inside the container body 151, three pairs of partition walls 151S are protruded from the inner wall on the roof side and the inner wall on the bottom side. Therefore, the solid processing tablets J accommodated in the container body 151 are lined up in such a manner that they are arranged in four rows. Substantially, four rows of communicated chambers 151A, 151B, 151C, 151D are formed. The ratio H'/H, in which H' is the height of the partition walls 151S and H is the height of the inner wall of the chambers 151A to 151D, is set in a range from 0.1 to 0.6. Thereby, the dryness of the solid processing tables J is improved.

Rail portions 151R are formed on both outside surfaces of the outlet opening portion 151F. These rail portions 151R are engaged with groove portions 151A formed on the insides of both sides of the opening and closing door 152, so that the rail portions 151R is capable of sliding in the groove portions 151A. In the case where the solid processing agent tablets J are replenished, the opening and closing door 152 is automatically opened and closed when the replenishing device is driven.

Figure 10:
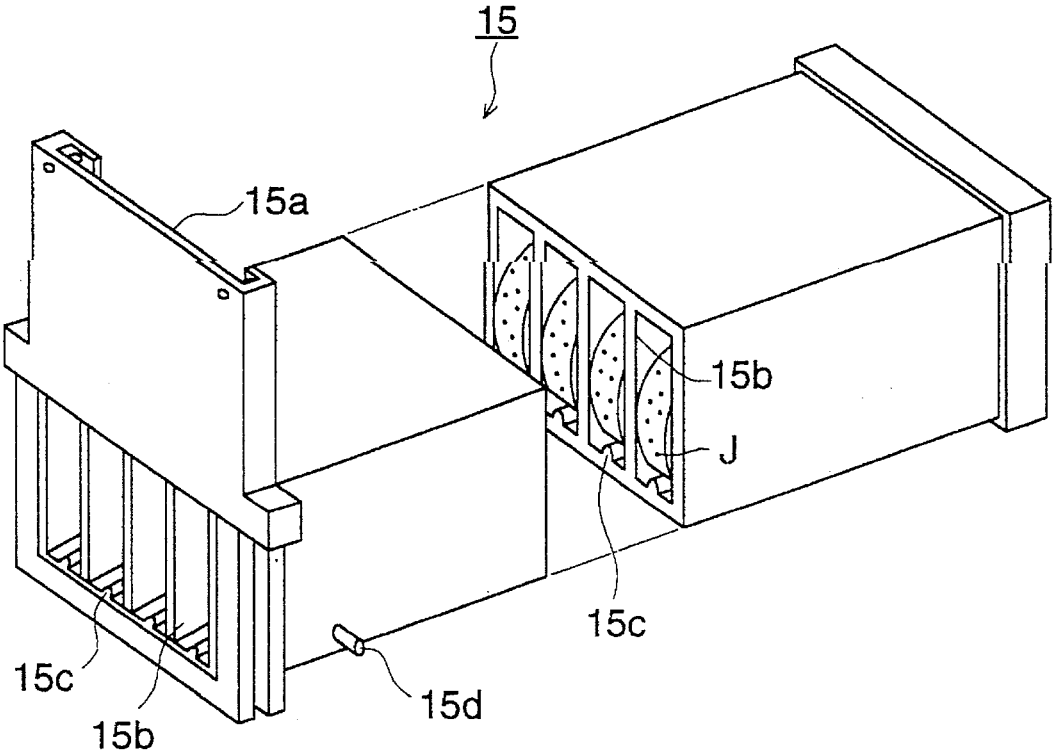
FIG. 10(A) is a perspective view and FIGS. 10(B)–10(H) are front views showing other examples of the solid processing agent containers.
Figure 10:
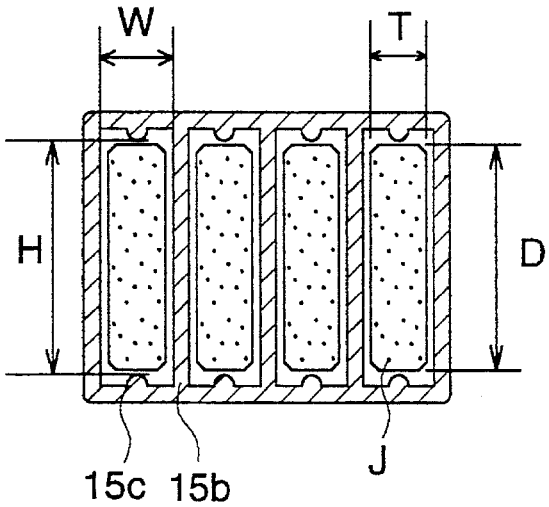
Figure 10:
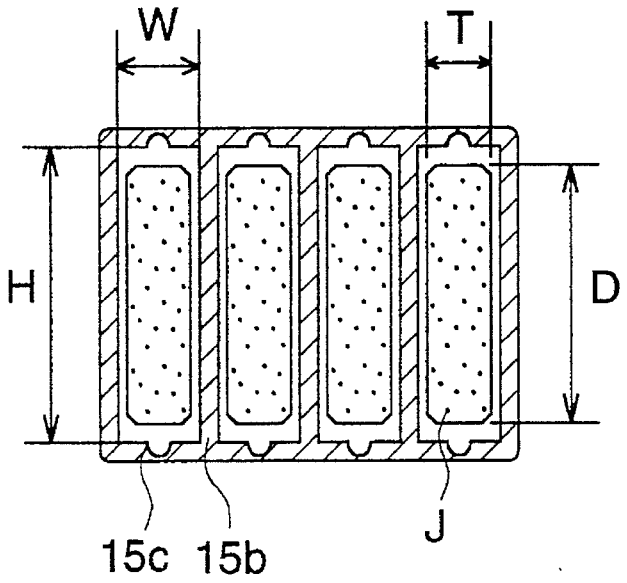
Figure 10:
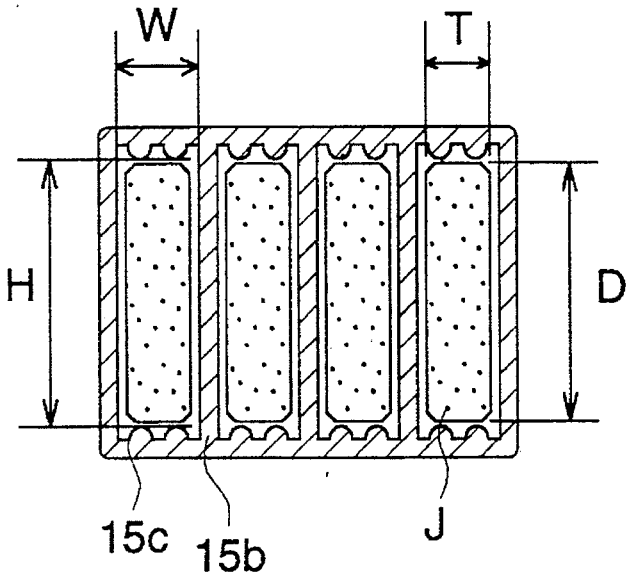
Figure 10:
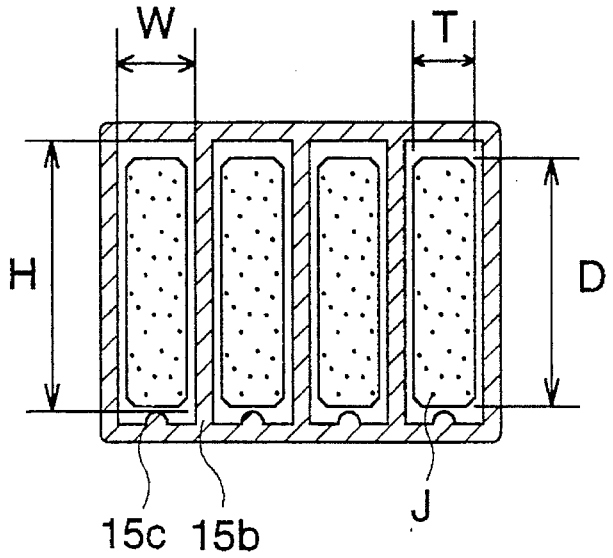
Figure 10:
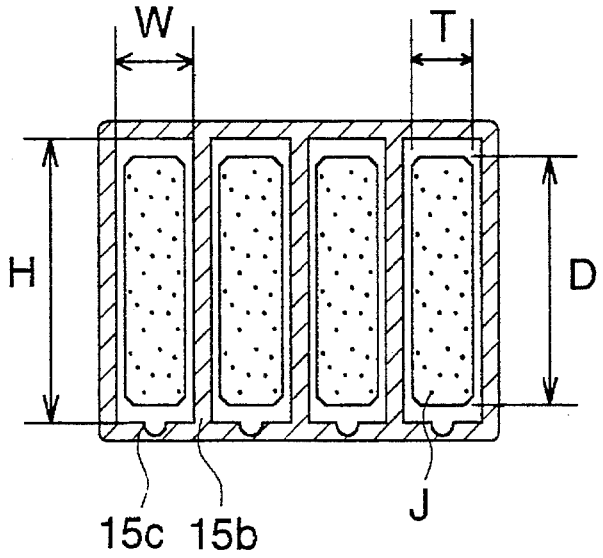
Figure 10:
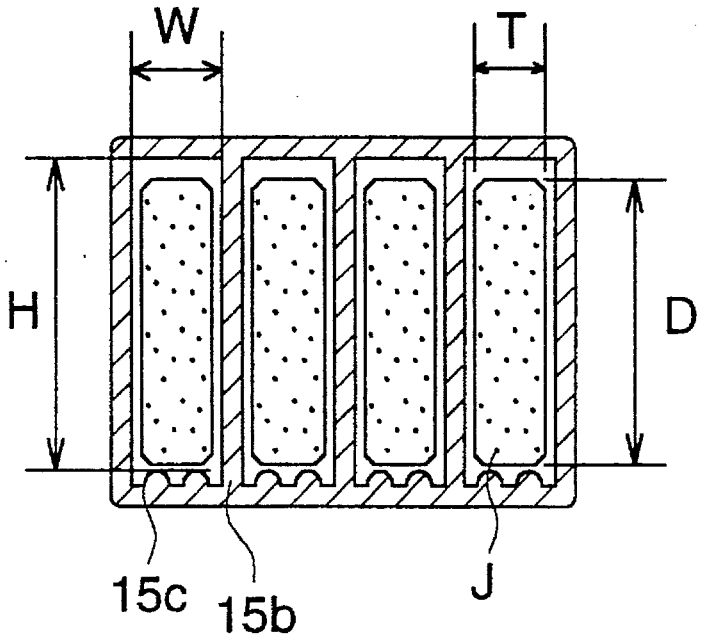
Figure 10:
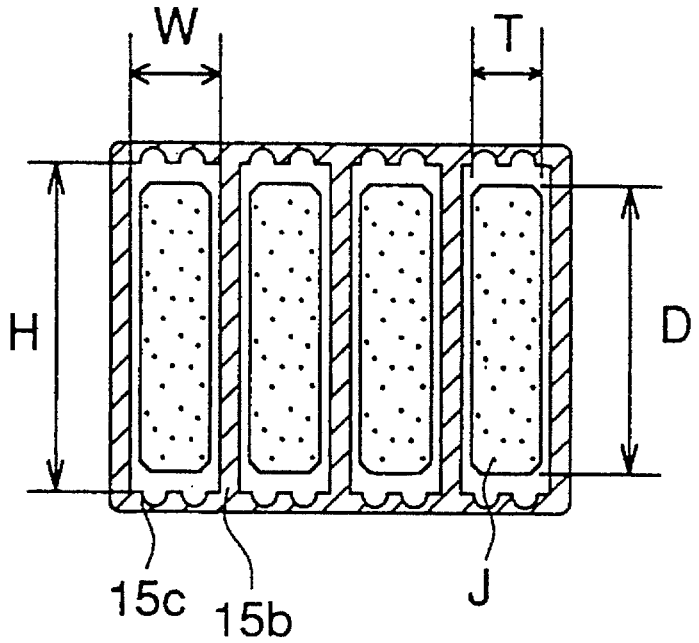

In this case, a ratio of H/D is set in a range from 1.03 to 1.50, in which H is the height of the inner wall of the chambers 151A to 151D, and D is the diameter of the solid processing agent tablet J accommodated in each chamber. A ratio of W/T is set in a range from 1.03 to 1.50, wherein W is the width of each chamber, and J is the thickness of the solid processing agent tablet J. When the dimensions of each chamber and solid processing agent tablet J are set in the manner described above, the solid processing agent tablets J are not damaged and powdered in the process of transportation and handling. FIGS. 10(A)–10(H) show other example of the solid processing agent containers 15 of the present invention. FIG. 10(A) is a partially exploded perspective view of the container, and FIGS. 10(B)–(H) are front views is a front view of the opening side of the container 15. In this example, the partition walls 15*b* are extended to positions close to the outlet opening. Therefore, the occurrence of damage and the generation of powder can be reduced, and further the effect of moisture-proof can be enhanced. Height H and width W of the chamber of container 15, and diameter D and thickness T of the solid processing agent tablet J shown in FIG. 10(B) are set as described in Example 1.

In FIG. 10(C), the configuration of the rail 15*c* is formed into a cut-out shape. In FIG. 10(D), the configuration of the rail 15*c* is formed into a protrusion shape, and two rows of rails 15*c* are provided. In the constructions shown in FIGS. 10(E), 10(F) and 10(G), the rails 15*c* provided on one side shown in FIGS. 10(B), 10(C) and 10(D) are omitted, and the configurations of the rails 15*c* are respectively formed into a protrusion shape wherein the number of rail rows is one, a cut-out shape wherein the number of rail rows is two, and a protrusion-shape wherein the number of rail rows is two FIG. 10(H), so that the rails are provided only on one side. In all these examples, the height H and width W of the chamber of container 15 are determined so that the ratios of the height H and width W with respect to the diameter D and thickness T of the solid processing agent tablet J can be the same as those shown in Example 1 described before.

EXAMPLE 2

In this example, the color development tablets for replenishment were used, which were made by the same method as that described in the example 10 in Japanese Patent Publication Open to Public Inspection No. 232656/1993. The configuration of the tablet was a short column, the diameter of which was 30 mm, and the thickness of which was 10 mm. In this example, the same container as that of Example 1 shown in FIG. 4 was used, wherein the dimensions of the container were changed as shown in Table 1. The package, which is composed of the container prepared in the manner described above and the solid processing agent, was subjected to a transportation test. The package was fixed onto a loading platform of a 4-ton truck. The truck was reciprocated twice between Tokyo and Hakata (about 1,200 km one way) on a common road, and the damage of tablets and the generation of powder were investigated. Further, the container was set in the tablet supply device used in Example 1, and the supplying condition of tablets was investigated.

The results of the test are shown in Table 1.

TABLE 1

| Test No. | H/D | W/T | Damage of tablets | Generation of powder | Supplying condition of tablet supply device | Remarks |
|---|---|---|---|---|---|---|
| 1-1 | 1.00 | 1.25 | Δ | o | × | Comparative example |
| 1-2 | 1.02 | 1.25 | Δ | o | × | Comparative example |
| 1-3 | 1.03 | 1.25 | o | o | Δ | Present invention |

TABLE 1-continued

| Test No. | H/D | W/T | Damage of tablets | Generation of powder | Supplying condition of tablet supply device | Remarks |
|---|---|---|---|---|---|---|
| 1-4 | 1.05 | 1.25 | o | o | o | Present invention |
| 1-5 | 1.10 | 1.25 | o | o | o | Present invention |
| 1-6 | 1.15 | 1.25 | o | o | o | Present invention |
| 1-7 | 1.20 | 1.25 | o | o | o | Present invention |
| 1-8 | 1.25 | 1.25 | Δ–o | Δ | Δ | Present invention |
| 1-9 | 1.30 | 1.25 | Δ–o | Δ | Δ | Present invention |
| 1-10 | 1.41 | 1.25 | Δ | Δ | Δ | Present invention |
| 1-11 | 1.50 | 1.25 | Δ | Δ | Δ | Present invention |
| 1-12 | 1.65 | 1.25 | × | × | × | Comparative example |
| 1-13 | 1.80 | 1.25 | ×× | × | × | Comparative example |
| 1-14 | 1.15 | 1.00 | Δ | o | × | Comparative example |
| 1-15 | 1.15 | 1.02 | Δ | o | × | Present invention |
| 1-16 | 1.15 | 1.03 | o | o | Δ | Present invention |
| 1-17 | 1.15 | 1.05 | o | o | Δ–o | Present invention |
| 1-18 | 1.15 | 1.10 | o | o | o | Present invention |
| 1-19 | 1.15 | 1.20 | o | o | o | Present invention |
| 1-20 | 1.15 | 1.25 | o | o | o | Present invention |
| 1-21 | 1.15 | 1.30 | o | o | o | Present invention |
| 1-22 | 1.15 | 1.35 | o | o | o | Present invention |
| 1-23 | 1.15 | 1.40 | Δ–o | Δ | o | Present invention |
| 1-24 | 1.15 | 1.45 | Δ | Δ | Δ | Present invention |
| 1-25 | 1.15 | 1.50 | Δ | Δ | Δ | Present invention |
| 1-26 | 1.15 | 1.65 | × | × | × | Comparative example |
| 1-27 | 1.15 | 1.80 | × | × | × | Comparative example |
| 1-28 | 1.02 | 1.02 | Δ | o | ×× | Comparative example |
| 1-29 | 1.65 | 1.65 | ×× | ×× | ×× | Comparative example |
| 1-30 | 1.02 | 1.65 | × | × | × | Comparative example |
| 1-31 | 1.65 | 1.02 | ×× | × | × | Comparative example |

Definitions of H, W, T and D are the same as those of Example 1.

In the evaluation on Table 1, the following criteria were adopted.

[Evaluation of damage of tablets]

o: No damage

Δ: Small damage (Substantially, no damage)

X: Damage (Conveyance of tablets is affected.)

XX: Half the number of tablets are damaged.

[Evaluation of generation of powder]

o: No powder

Δ: Small amount of powder

X: Large amount of powder

[Evaluation of supply of the tablet supply device]

○: No problem

Δ: Supplying operation is not smooth.

X: Defective supplying operation

The following can be seen from Table 1. When the following inequalities are satisfied, excellent effects can be provided.

$1.03 \leqq H/D \leqq 1.50$ and $1.03 \leqq W/T \leqq 1.50$ where H is the height and W is the width of the chamber, and D is the diameter and T is the width of the tablet J.

Especially when the following inequalities are satisfied, more excellent effects can be provided.

$1.03 \leqq H/D \leqq 1.30$ and $1.05 \leqq W/T \leqq 1.40$

EXAMPLE 3

Material of the processing agent container used in the test No. 1–7 of Example 2 was changed as shown in Table 2. Other conditions were the same as those of Example 2, and the same test were carried out. The results are also shown in Table 2.

TABLE 2

| Test No. | Material of the container | Damage of tablets | Generation of powder | Suppling condition of tablet supply device |
|---|---|---|---|---|
| 2-1 | High density polyethylene | ○ | ○ | ○ |
| 2-2 | Polypropylene | Δ–○ | ○ | ○ |
| 2-3 | Polyvinylidene chloride | Δ–○ | Δ–○ | ○ |
| 2-4 | Stainless steel (SUS 304) | Δ | Δ | ○ |
| 2-5 | Aluminum | Δ | Δ | ○ |

The criteria in Table 2 are the same as those of Example 2.

From Table 2, it can be seen that a synthetic resin is preferably used for the material of the container, and especially polyethylene is more preferably used.

EXAMPLE 4

Bulk density of the tablets used in the test No. 1–7 of Example 2 was changed as shown in Table 3 when the compression pressure of the press machine was adjusted and also an amount of addition of polyethylene glycol (the average molecular weight: 4000) was adjusted, and other conditions were the same as those of Example 2. In this way, the experiment was made. Further, the dissolution speed was found when each tablet was stirred and dissolved in a beaker. The results are shown in Table 3.

TABLE 3

| Test No. | Bulk density | Damage of tablets | Generation of powder | Supplying condition of tablet supply device | Dis-solution speed |
|---|---|---|---|---|---|
| 3-1 | 1.02 | Δ | Δ | Δ | ○ |
| 3-2 | 1.05 | Δ | Δ | Δ–○ | ○ |
| 3-3 | 1.10 | Δ | ○ | ○ | ○ |
| 3-4 | 1.20 | ○ | ○ | ○ | ○ |
| 3-5 | 1.50 | ○ | ○ | ○ | ○ |
| 3-6 | 1.90 | ○ | ○ | ○ | ○ |

TABLE 3-continued

| Test No. | Bulk density | Damage of tablets | Generation of powder | Supplying condition of tablet supply device | Dis-solution speed |
|---|---|---|---|---|---|
| 3-7 | 2.0 | ○ | ○ | ○ | ○ |
| 3-8 | 2.4 | ○ | ○ | ○ | ○ |
| 3-9 | 2.7 | ○ | ○ | ○ | Δ |
| 3-10 | 3.0 | Δ | ○ | ○ | Δ |
| 3-11 | 3.3 | Δ | ○ | ○ | Δ–× |

The criteria in Table 3 are the same as those shown in Table 1 of Example 2. Concerning the dissolution speed, mark ○ expresses the dissolution made in 10 minutes, mark Δ expresses the dissolution made in 10 to 20 minutes, and mark X expresses the dissolution requiring not less than 20 minutes.

From Table 3, it can be seen that the bulk density of tablets is preferably 1.1 to 3.0 g/cm$^3$ in the present invention, and more preferably the bulk density of tablets is 1.2 to 2.4 g/cm$^3$.

According to the present invention, the following effect can be provided. When the container accommodating tablets used for processing silver halide photosensitive material is transported or handled, the tablets are not damaged and powdered.

What is claimed is:

1. A transportable package for use in a silver halide photosensitive material processing apparatus, comprising:

a plurality of processing agent tablets for processing said silver halide material;

a container including an elongated chamber containing the plurality of said tablets in succession while standing on circumferential tablet edges;

said chamber having a height (H) in a range from 1.03 to 1.50 times larger than a diameter (D) of said tablets; and said chamber having a width (W) in a range from 1.03 to 1.50 times larger than a thickness (T) of said tablets.

2. The package of claim 1, wherein a bulk density of said tablets is between 1.0 and 2.5 g/cm$^3$.

3. The package of claim 1, wherein a mechanical strength (Z) of said tablets is between 0.3 and 3.5 kg/mm.

4. The package of claim 1, wherein a water content of said tablets is between 0.1 and 15 weight %.

5. The package of claim 1, wherein said tablets contain a color developer including at least one of a developing agents, antioxidant, development inhibitor, alkali agent, optical brightening agent, and development accelerator.

6. The package of claim 1, wherein said tablets include at least one of a bleaching agent, halide, and bleaching accelerator.

7. The package of claim 1, wherein said tablets include at least one of a fixing agent, antioxidant, pH adjusting agent, and fixing accelerator.

8. The package of claim 1, wherein said tablets include at least one of a bleaching agent, halide, bleaching accelerator, a fixing agent, antioxidant, pH adjusting agent, and fixing accelerator.

9. The package of claim 1, wherein said tablets include at least one of a surface active agent, formaldehyde substitute compound, chelate agent, fungicide, and antioxidant.

10. The package of claim 1, wherein said container is made of a synthetic resin.

11. The package of claim 10, wherein said door member includes a protuberance facilitating opening movement of the door member in response to dispensing installation of the package in the processing apparatus.

12. The package of claim 10, wherein said synthetic resin is polyethylene.

13. The package of claim 1, further comprising a door member mounted to the container for movement between an open position and a closed position relative to an open end of said chamber through which said tablets are dispensed.

14. The package of claim 1, wherein said container includes:

a plurality of said chambers for respectively accommodating plural rows of said tablets; and at least one rail member, provided in each of said chambers, on which said tablets are supported for rolling motion.

15. The package of claim 14, wherein said rail members have a protrusion shape, and each said chamber provided with at least two of said rail members, one at an upper chamber wall and another one at a lower chamber wall.

16. The package of claim 14, wherein said rail members have a protrusion shape, each said chamber provided with plural said rail members at each of upper and lower chamber walls.

17. The package of claim 14, wherein said rail members have a cut-out shape, and each said chamber is provided with at least two of said rail members, one at an upper chamber wall and another one at a lower chamber wall.

18. The package of claim 14, wherein said rail members have a cut-out shape, and each said chamber is provided with plural said rail members at each of upper and lower chamber walls.

19. The package of claim 14, wherein said rail members have a protrusion shape, each said chamber is provided with at least one said rail member at one of upper and lower chamber walls.

20. The package of claim 14, wherein said rail members have protrusion shape, and each said chamber is provided with at least two of said rail members at one of upper and lower chamber walls.

21. The package of claim 14, wherein said rail members have a cut-out shape, and each said chamber is provided with at least one said rail member at one of upper and lower chamber walls.

22. The package of claim 14, wherein said rail members have a cut-out shape, each said chamber is provided with at least two of said rail members at one of upper and lower chamber walls.

23. The package of claim 1, wherein said chamber is open along a length thereof, such that said tablets reside in said container body in mutual circumferential edge contacting relation.

24. The package of claim 1, wherein said container includes:

at least a pair of vertically spaced partitions for separating an interior of said container into at least a pair of said chambers, each accommodating a row of said tablets; wherein a height H' of one of said partitions and a height H" of one of said chambers satisfy:

$$0.1 \leqq H'/H'' \leqq 0.6.$$

* * * * *